US007721580B2

(12) United States Patent
Denker

(10) Patent No.: US 7,721,580 B2
(45) Date of Patent: May 25, 2010

(54) APPARATUS FOR ROTATIONALLY LOCKING A ROLLER-MILL ROLL IN A BEARING MOUNT IN A MOUNT WINDOW OF A ROLLING-MILL FRAME

(75) Inventor: Wolfgang Denker, Freudenberg (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 222 days.

(21) Appl. No.: 11/578,736

(22) PCT Filed: May 12, 2006

(86) PCT No.: PCT/EP2006/004463

§ 371 (c)(1),
(2), (4) Date: Oct. 17, 2006

(87) PCT Pub. No.: WO2006/122710

PCT Pub. Date: Nov. 23, 2006

(65) Prior Publication Data

US 2009/0249854 A1 Oct. 8, 2009

(30) Foreign Application Priority Data

May 14, 2005 (DE) ..... 10 2005 022 440

(51) Int. Cl.
*B21B 31/08* (2006.01)

(52) U.S. Cl. ..... 72/238

(58) Field of Classification Search ..... 72/237, 72/238, 239, 247, 249
See application file for complete search history.

(56) References Cited

U.S. PATENT DOCUMENTS

| | | | | |
|---|---|---|---|---|
| 2,448,278 | A | 8/1948 | Ronning | 192/71 |
| 2,885,231 | A | 5/1959 | Smith | 403/227 |
| 3,689,126 | A * | 9/1972 | Hayashi et al. | 384/559 |
| 4,264,229 | A | 4/1981 | Falk | 403/5 |
| 4,650,364 | A * | 3/1987 | Kark | 403/368 |
| 5,141,350 | A | 8/1992 | Hecke | 403/15 |
| 5,224,789 | A | 7/1993 | Elsner | 403/5 |
| 5,600,987 | A | 2/1997 | Moritz et al. | |
| 5,735,157 | A * | 4/1998 | Yamamoto et al. | 72/164 |
| 7,082,800 | B1 * | 8/2006 | Muller et al. | 72/237 |
| 7,337,643 | B2 * | 3/2008 | Weiermair et al. | 72/249 |
| 7,396,021 | B2 * | 7/2008 | Keller et al. | 277/551 |

FOREIGN PATENT DOCUMENTS

| | | |
|---|---|---|
| DE | 3019085 | 11/1981 |
| DE | 3110377 | 10/1992 |

* cited by examiner

*Primary Examiner*—Edward Tolan
(74) *Attorney, Agent, or Firm*—Andrew Wilford

(57) ABSTRACT

An apparatus for rotationally locking a rolling-mill roll in the bearing mount LS in a rolling-mill frame has an axially shiftable housing fitted to the stub (WZ) of the roll, having a planar flange (FA) that in one position of the housing bears on an abutment face of an abutment element fixed in the bearing mount (LS).

5 Claims, 2 Drawing Sheets

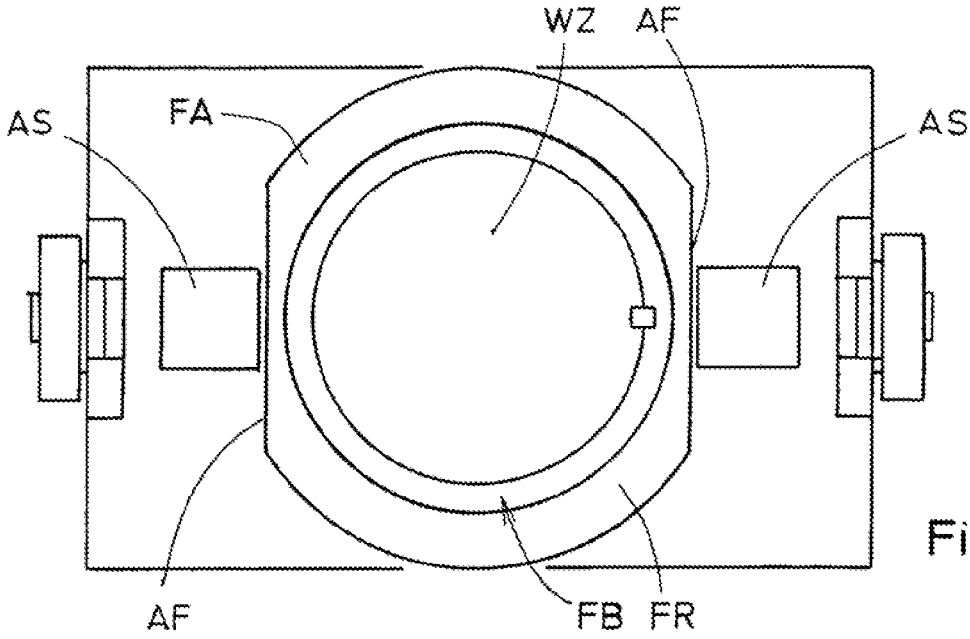
Fig. 1
Fig. 2
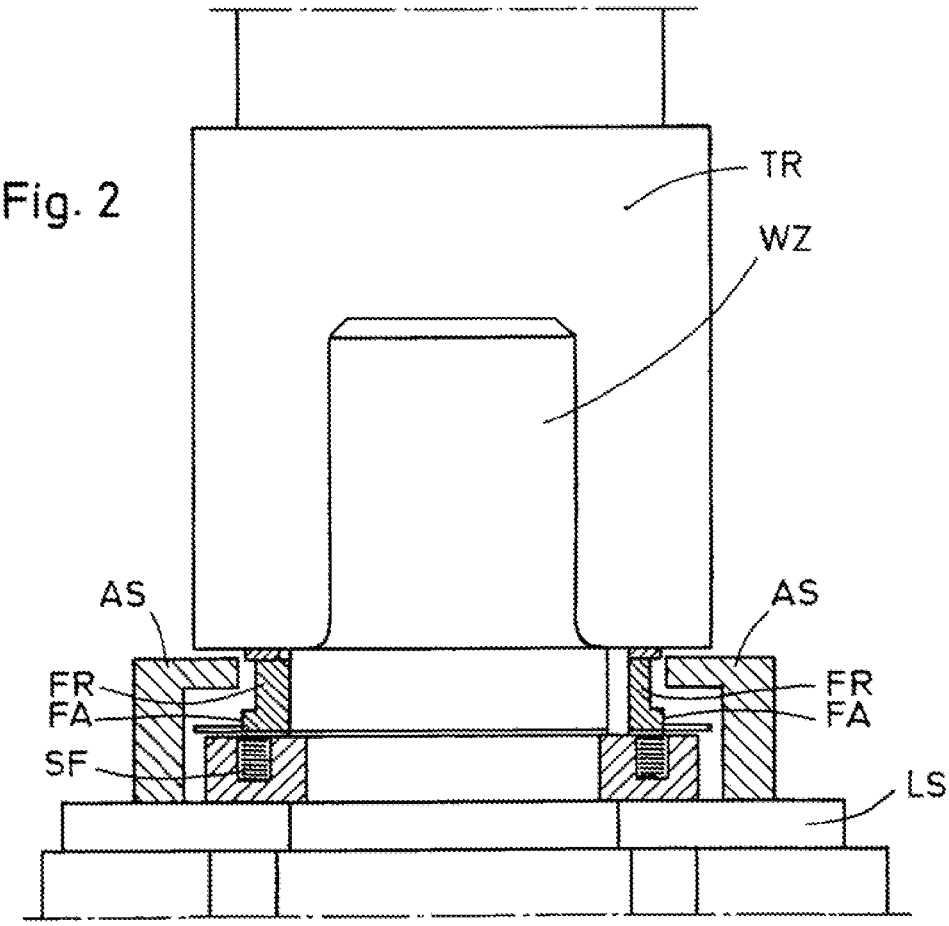

Fig. 3
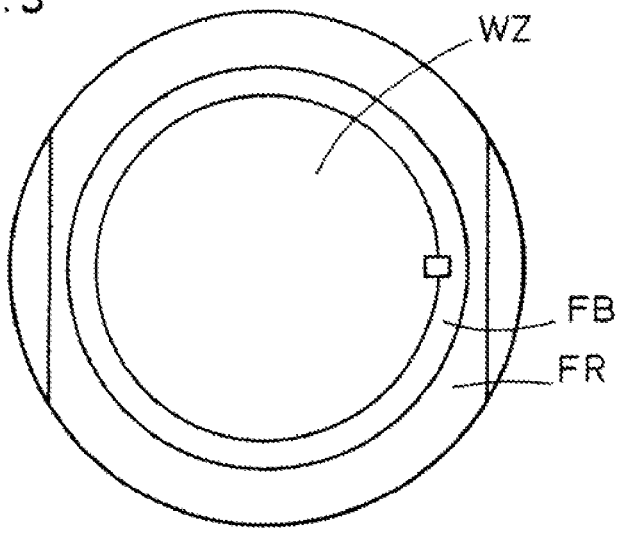
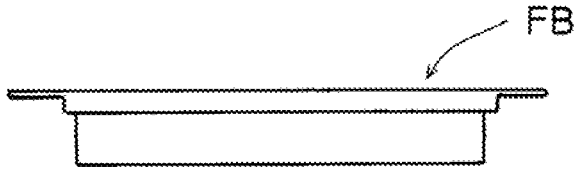
Fig. 5
Fig. 4
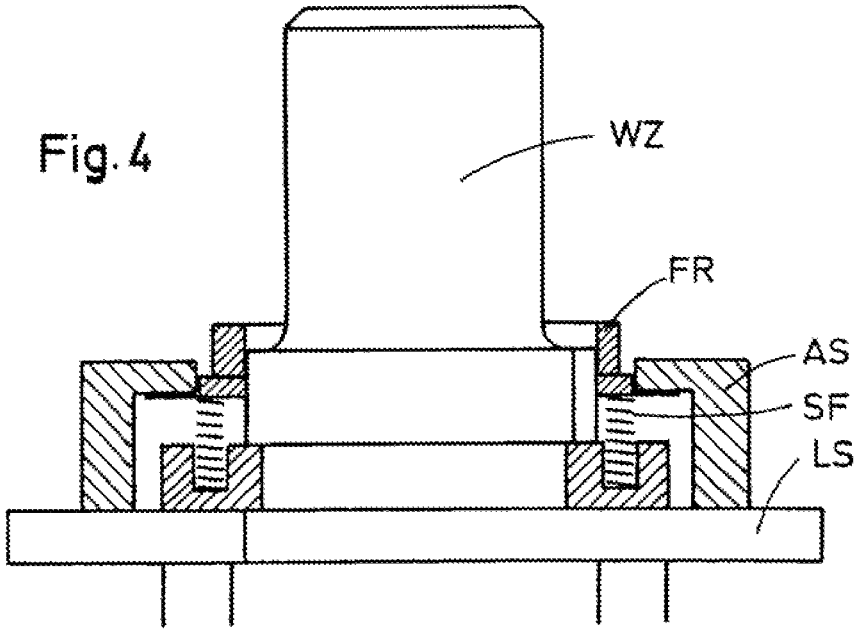

APPARATUS FOR ROTATIONALLY LOCKING A ROLLER-MILL ROLL IN A BEARING MOUNT IN A MOUNT WINDOW OF A ROLLING-MILL FRAME

CROSS REFERENCE TO RELATED APPLICATIONS

This application is the US national phase of PCT application PCT/EP2006/004463, filed 12 May 2006 and claiming the priority of German patent application 102005022440.7 itself filed 14 May 2005, whose entire disclosures are herewith incorporated by reference.

FIELD OF THE INVENTION

The invention relates to an apparatus for rotationally locking a rolling-mill roll in a bearing mount in a mount window of a rolling-mill frame.

BACKGROUND OF THE INVENTION

When changing such rolls one normally uses rail systems with whose help the rolls are shifted with their bearing mounts through the mount windows of the rolling-mill frame. These rails and the equipment used for such an operation take a great deal of space up at the roll frame and make it difficult to mount or move other equipment needed for rolling.

It has therefore been suggested to change rolls by means of a support beam, a so-called porter bar. To this end the stub of the roll is connected to a porter bar suspended from a crane, and the roll is lifted in this position out of the frame. With this method there is the problem that the bearing mount rotates on the roll as it is being moved.

OBJECT OF THE INVENTION

The object of the invention is to provide an apparatus that rotationally locks the bearing mount to the roll during removal, transport, and reinstallation in the roll frame and until it is reconnected to the drive element.

SUMMARY OF THE INVENTION

This object is achieved by an axially shiftable cylindrical housing fitted to the stub of the roll, having a planar flange that in one position of the housing bears on an abutment face of an abutment element fixed in the bearing mount so that the cylindrical housing is rotationally locked in the bearing mount. Further according to the invention the housing is a cylindrical flange ring having the flange with a planar face. Further features of the invention are described in the dependent claims.

BRIEF DESCRIPTION OF THE DRAWING

The invention will be more closely described with reference to the embodiment of the apparatus shown in the drawing. In the drawing in a schematic illustration:

FIG. 1 is a radial section through a roll stub and slide housing in the direction of the bearing mount;

FIG. 2 is a side view of the section of FIG. 1;

FIG. 3 is a view of another radial section like FIG. 1;

FIG. 4 is a side view of FIG. 3; and

FIG. 5 is a detail of the view of FIG. 3.

SPECIFIC DESCRIPTION

As shown in FIGS. 1 and 2 a roll stub WZ carries an axially shiftable flange sleeve FB having a flange ring FR and a planar outer flange FA. A bearing mount LS has abutments AS with abutment faces for the planar flange FA of the flange ring FR. As shown in FIG. 2 the roll stub WZ is fitted to the drive element TR of the roll drive, and the lower face of the flange ring FR is supported in the bearing mount LS on springs SF that push the flange ring FR against an end face of the drive element TR. In this position the planar flange FA of the flange ring FR is offset from the abutments AS so that the roll stub WZ with the flange ring FR can rotate freely in the bearing mount LS. If the roll stub WZ is separated from the drive element TR as shown in FIG. 4 to carry off the roll, the springs SF push the flange ring FR in the bearing mount LS into a position in which its abutment faces AF bear on the abutments AS and the flange ring is blocked against rotation on the roll stub WZ. This blocking is effective until the roll with the bearing mount LS is fitted to the roll frame and the roll stub WZ is fitted to the drive element TR to shift the flange ring FR back into the FIG. 2 position.

The invention claimed is:

1. In a rolling-mill roll having a roll stub rotatable about an axis in a stationary bearing mount and fittable axially with a rotatable drive element, an apparatus comprising:

an annular housing rotationally fixed to and axially shiftable on the roll stub and axially engageable with the drive element and with a stationary abutment of the bearing mount, the housing being axially shiftable on the stub between an outer position in which the abutment rotationally arrests the roll stub in the bearing mount and an inner position in which the roll stub and the bearing mount are relatively rotatable; and springs axially braced against the housing and urging the housing axially toward the drive element, into the outer position, and toward the stationary abutment, whereby engagement of the drive element with the housing pushes the housing out of engagement with the abutment.

2. The apparatus defined in claim 1 wherein the housing has a planar flange engageable with the abutment face.

3. The apparatus defined in claim 1 wherein the springs are axially extending compression springs.

4. The apparatus defined in claim 2 wherein the flange has abutment face engageable with the abutment only in the outer position.

5. The apparatus defined in claim 3 wherein the abutment face is a flat formed on the flange.

* * * * *